US011769517B2

(12) United States Patent
Sugiyama et al.

(10) Patent No.: US 11,769,517 B2
(45) Date of Patent: Sep. 26, 2023

(54) SIGNAL PROCESSING APPARATUS, SIGNAL PROCESSING METHOD, AND SIGNAL PROCESSING PROGRAM

(71) Applicants: NEC Corporation, Tokyo (JP); NEC Platforms, Ltd., Kawasaki (JP)

(72) Inventors: Akihiko Sugiyama, Tokyo (JP); Ryoji Miyahara, Kanagawa (JP)

(73) Assignees: NEC CORPORATION, Tokyo (JP); NEC Platforms, Ltd., Kanagawa (JP)

( * ) Notice: Subject to any disclaimer, the term of this patent is extended or adjusted under 35 U.S.C. 154(b) by 298 days.

(21) Appl. No.: 17/270,356

(22) PCT Filed: Aug. 24, 2018

(86) PCT No.: PCT/JP2018/031456
§ 371 (c)(1),
(2) Date: Feb. 22, 2021

(87) PCT Pub. No.: WO2020/039598
PCT Pub. Date: Feb. 27, 2020

(65) Prior Publication Data

US 2021/0335379 A1 Oct. 28, 2021

(51) Int. Cl.
*G10L 21/0324* (2013.01)
*G10L 25/93* (2013.01)
(Continued)

(52) U.S. Cl.
CPC ..... *G10L 21/0324* (2013.01); *G10L 21/0208* (2013.01); *G10L 21/0216* (2013.01);
(Continued)

(58) Field of Classification Search
CPC ..... G10L 21/0208; G10L 21/0232; G10L 21/0216; G10L 21/02; G10L 21/0316; G10L 21/0324; G10L 25/93
See application file for complete search history.

(56) References Cited

U.S. PATENT DOCUMENTS 4,641,342 A * 2/1987 Watanabe ..... G10L 15/32 704/E11.005
6,415,253 B1 * 7/2002 Johnson ..... G10L 21/0208 704/226
(Continued)

FOREIGN PATENT DOCUMENTS

JP H04-115299 A 4/1992
JP 2002-204175 A 7/2002
(Continued)

OTHER PUBLICATIONS

Sugiyama et al., "Tapping-noise suppression with magnitude-weighted phase-based detection." 2013 IEEE Workshop on Applications of Signal Processing to Audio and Acoustics. IEEE (Year: 2013).*
(Continued)

*Primary Examiner* — Samuel G Neway
(74) *Attorney, Agent, or Firm* — Sughrue Mion, PLLC

(57) ABSTRACT

This invention provides a signal processing apparatus capable of obtaining an output signal of sufficiently high quality if the phase of an input signal is largely different from the phase of a true voice. The signal processing apparatus includes a voice detector that receives a mixed signal including a voice and a signal other than the voice and obtains existence of the voice as a voice flag, a corrector that receives the mixed signal and the voice flag and obtains a corrected mixed signal generated by correcting the mixed signal in accordance with a state of the voice flag, and a shaper that receives the corrected mixed signal and shapes the corrected mixed signal.

7 Claims, 12 Drawing Sheets

(51) Int. Cl.
*G10L 21/0232* (2013.01)
*G10L 21/0316* (2013.01)
*G10L 21/0216* (2013.01)
*G10L 21/0208* (2013.01)

(52) U.S. Cl.
CPC ..... *G10L 21/0232* (2013.01); *G10L 21/0316* (2013.01); *G10L 25/93* (2013.01); *G10L 2025/935* (2013.01)

(56) References Cited

U.S. PATENT DOCUMENTS 7,590,528 B2 * 9/2009 Kato ..... G10L 21/0208 704/226
2004/0049383 A1 3/2004 Kato et al.
2010/0010808 A1 * 1/2010 Sugiyama ..... G10L 21/0208 704/203
2011/0131044 A1 6/2011 Fukuda et al.
2012/0224718 A1 * 9/2012 Sugiyama ..... G10L 21/0272 381/94.1
2013/0332500 A1 * 12/2013 Sugiyama ..... H03H 17/06 708/300
2016/0019914 A1 * 1/2016 Sugiyama ..... A61B 5/024 381/56
2016/0055863 A1 * 2/2016 Kato ..... G10L 21/034 704/203
2021/0335379 A1 * 10/2021 Sugiyama ..... G10L 21/034

FOREIGN PATENT DOCUMENTS

JP 2011-100082 A 5/2011
JP 2011-113044 A 6/2011
WO 2016/203753 A1 12/2016

OTHER PUBLICATIONS

Sugiyama et al., "Impact-noise suppression with phase-based detection." 21st European Signal Processing Conference (EUSIPCO 2013). IEEE (Year: 2013).*
International Search Report for PCT Application No. PCT/JP2018/031456, dated Sep. 10, 2018.
Sugiyama, Akihiko, Single-Channel Impact-Noise Suppression with No Auxiliary Information for its Detection, Proc. 2017 IEEE Workshop on Applications of Signal Processing to Audio and Acoustics, Oct. 21-24, 2007, pp. 127-130, USA.
Yamato, Kazuhiro et al., Post-Processing Noise Suppressor with Adaptive Gain-Flooring for Cell-Phone Handsets and IC Recorders, Proc. 2007 Digest of Technical Papers International Conference on Consumer Electronics, Jan. 10, 2007, pp. 1-2.

* cited by examiner

SIGNAL PROCESSING APPARATUS, SIGNAL PROCESSING METHOD, AND SIGNAL PROCESSING PROGRAM

This application is a National Stage Entry of PCT/JP2018/031456 filed on Aug. 24, 2018, the contents of all of which are incorporated herein by reference, in their entirety.

TECHNICAL FIELD

The present invention relates to a technique of receiving an input signal including a plurality of components and enhancing at least one component.

BACKGROUND ART

In the above technical field, patent literature 1 includes a description concerning a technique of inputting a mixed signal of a voice and noise, enhancing the voice, and outputting it.

CITATION LIST

Patent Literature

Patent literature 1: Japanese Patent Laid-Open No. 2002-204175

SUMMARY OF THE INVENTION

Technical Problem

However, this technique obtains an enhanced amplitude by performing enhancement processing only for the amplitude component of the input signal and directly combines the phase component of the input signal with the enhanced amplitude to generate an output signal. Hence, if the phase of the input signal is largely different from the phase of the true voice, it is impossible to obtain an output signal of sufficiently high quality. In particular, if the power of the voice is not sufficiently larger than the power of noise, it is impossible to obtain an output signal of sufficiently high quality.

The present invention enables to provide a technique of solving the above-described problem.

Solution to Problem

According to the present invention, a voice included in an input signal is detected, and the input signal is corrected in correspondence with the existence of the voice. In addition, the corrected input signal is shaped and output as an enhanced signal.

Advantageous Effects of Invention

According to the present invention, after a voice included in an input signal is detected, and the input signal is corrected in correspondence with the existence of the voice, the signal is further shaped and output as an enhanced signal. Hence, even if the phase of the input signal is largely different from the phase of the true voice, an output signal of sufficiently high quality can be obtained.

DESCRIPTION OF EXAMPLE EMBODIMENTS

Example embodiments of the present invention will now be described in detail with reference to the drawings. It should be noted that the relative arrangement of the components, the numerical expressions and numerical values set forth in these example embodiments do not limit the scope of the present invention unless it is specifically stated otherwise. Note that "voice signal" in the following description is a direct electrical change that occurs according to a voice or another sound and means a signal used to transmit a voice or another sound, and is not limited to a voice. In some example embodiments, an apparatus in which the number of mixed signals to be input is four will be described. However, this is merely an example, and the same description applies to an arbitrary signal count of two or more. Additionally, in the description even if the amplitude of a signal used in a portion is replaced with the power of the signal, and the power of a signal used in a portion is replaced with the amplitude of the signal, the same description applies. This is because a power is obtained as the square of an amplitude, and an amplitude is obtained as the square root of a power.

First Example Embodiment

Figure 1:
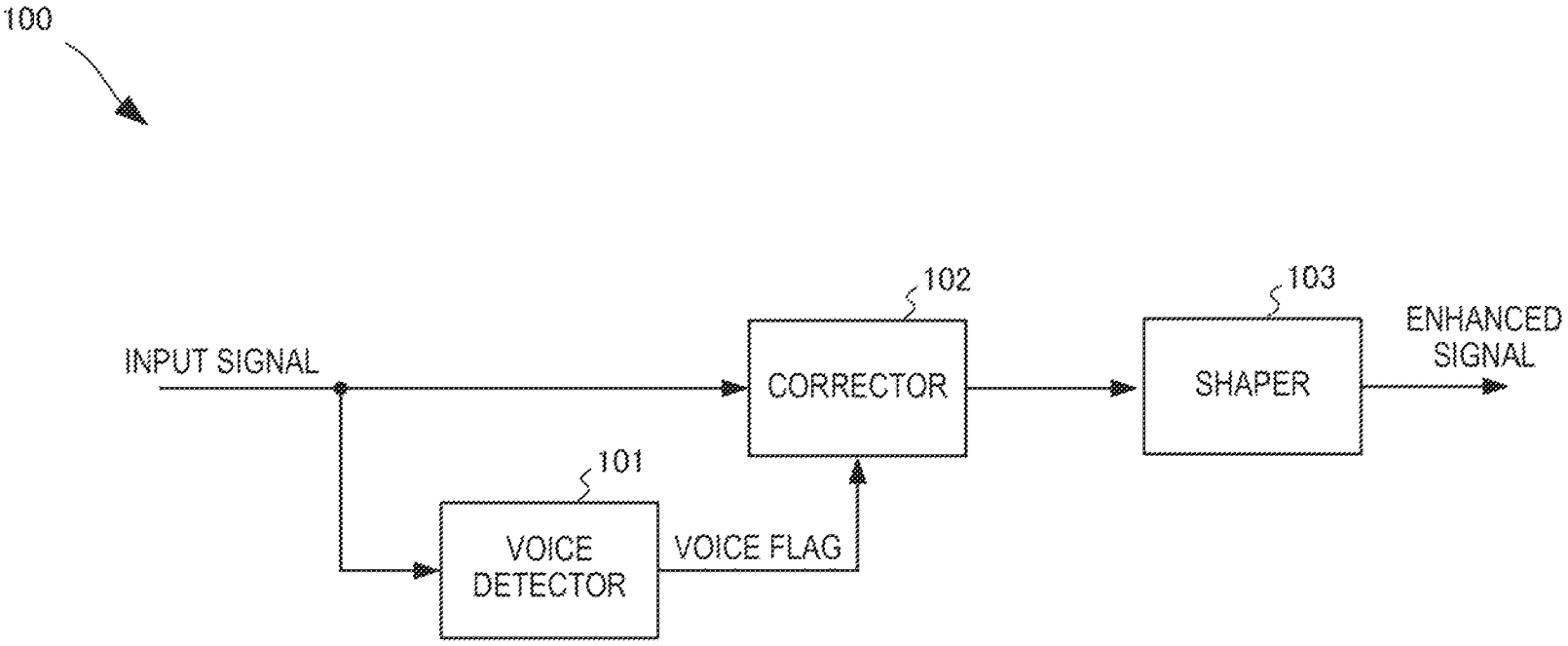
FIG. 1 is a block diagram showing the arrangement of a signal processing apparatus according to the first example embodiment of the present invention.

A signal processing apparatus 100 according to the first example embodiment of the present invention will be described with reference to FIG. 1. The signal processing apparatus 100 is an apparatus that inputs a mixed signal in which a voice and noise are mixed from a sensor such as a microphone or an external terminal, enhances the voice, and suppresses the noise. As shown in FIG. 1, the signal processing apparatus 100 includes a voice detector 101, a corrector 102, and a shaper 103.

The voice detector 101 receives a mixed signal, detects the existence of a voice, and outputs it as a voice flag. The corrector 102 receives the mixed signal and the voice flag, and corrects the input signal. The shaper 103 obtains a corrected mixed signal by correcting the mixed signal received from the corrector 102, and outputs it as an enhanced signal.

The signal processing apparatus 100 corrects the mixed signal in correspondence with the existence of the voice included in the mixed signal, and then further shapes the signal and outputs it as an enhanced signal. Hence, even if the phase of the mixed signal is largely different from the phase of the true voice, an output signal of sufficiently high quality can be obtained.

Second Example Embodiment

Figure 2:
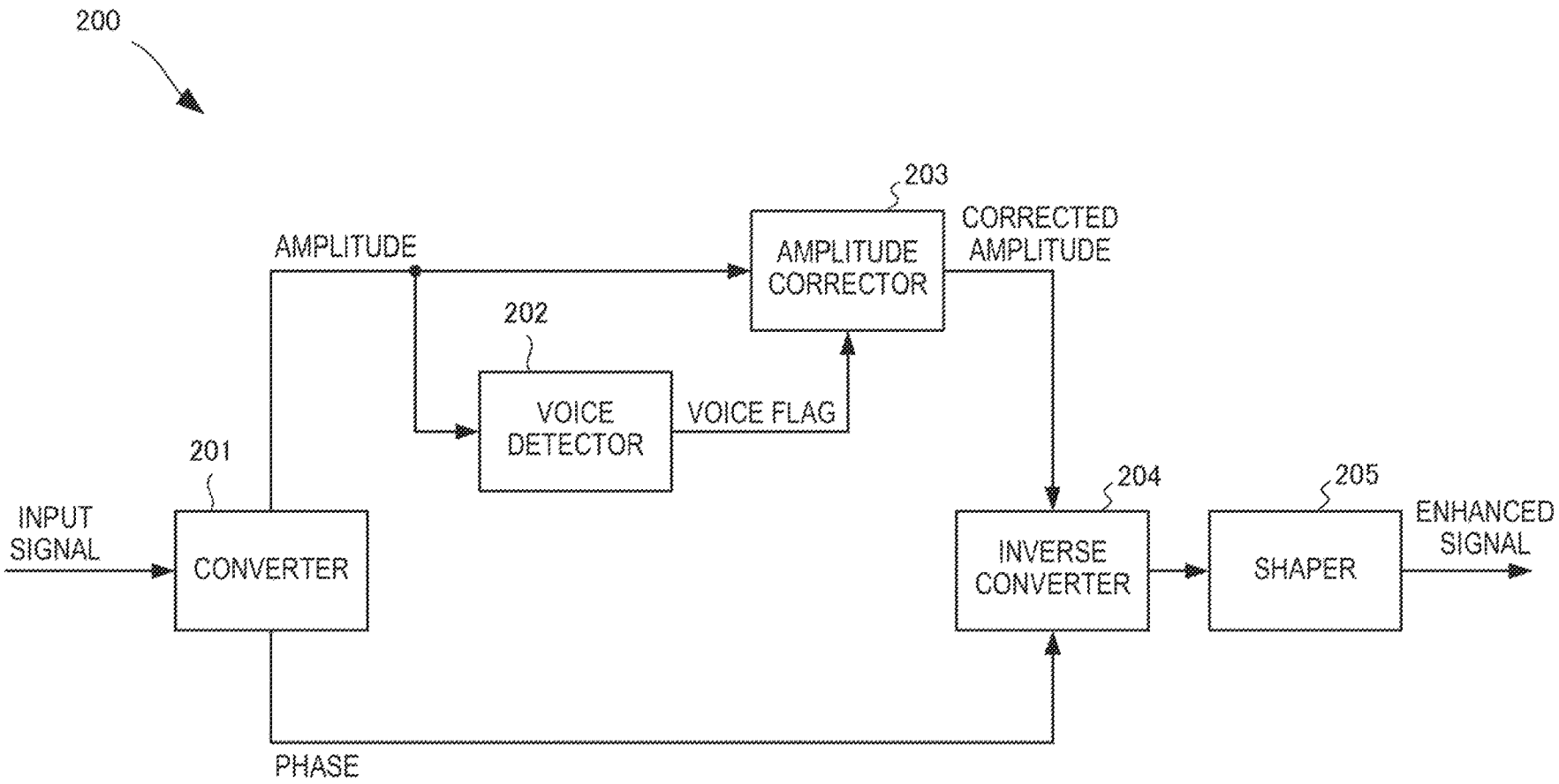
FIG. 2 is a block diagram showing the arrangement of a signal processing apparatus according to the second example embodiment of the present invention.

A signal processing apparatus 200 according to the second example embodiment of the present invention will be described with reference to FIG. 2. The signal processing apparatus 200 is an apparatus that inputs a mixed signal in which a voice and noise are mixed from a sensor such as a microphone or an external terminal, enhances the voice, and suppresses the noise. As shown in FIG. 2, the signal processing apparatus 200 includes a converter 201, a voice detector 202, an amplitude corrector 203, an inverse converter 204, and a shaper 205.

The converter 201 receives a mixed signal, puts a plurality of signal samples into blocks, and decomposes them into amplitudes and phases at a plurality of frequency components by applying frequency conversion. As the frequency conversion, various transformations such as Fourier transformation, cosine transformation, sine transformation, wavelet transformation, and Hadamard transform can be used. Additionally, before the conversion, multiplication of a window function is widely performed on a block basis. Also, overlap processing of making a part of a block overlap a part of an adjacent block is widely applied. It is also possible to integrate the plurality of obtained signal samples into a plurality of groups (sub-bands) and commonly use a value representing each group for frequency components in each group. It is also possible to handle each sub-band as a new frequency point and decrease the number of frequency points. Furthermore, instead of performing frequency conversion based on block processing, processing on a sample basis can be performed using an analysis filter bank to obtain data corresponding to a plurality of frequency points. At this time, a uniform filter bank in which the frequency points are arranged at equal intervals on the frequency axis or a nonuniform filter bank in which the frequency points are arranged at inequal intervals can be used. In the nonuniform filter bank, setting is done such that the frequency interval is narrow in the important frequency band of an input signal. For a voice, setting is done such that the frequency interval is narrow in a low-frequency region.

The voice detector 202 receives amplitudes at the plurality of frequencies from the converter 201, detects the existence of a voice, and outputs it as a voice flag. The amplitude corrector 203 corrects the amplitudes at the plurality of frequencies, which are received from the converter 201, in accordance with the state of the voice flag from the voice detector 202, and outputs it as a corrected amplitude.

The inverse converter 204 receives the corrected amplitude from the amplitude corrector 203 and the phase from the converter 201, obtains a time domain signal by applying inverse frequency conversion, and outputs it. The inverse converter 204 performs inverse conversion of the conversion applied by the converter 201. For example, if the converter 201 executes Fourier transformation, the inverse converter 204 executes inverse Fourier transformation. As in the converter 201, a window function or overlap processing is also widely applied. When the converter 201 integrates the plurality of signal samples into the plurality of groups (sub-bands), a value representing each sub-band is copied as the value of all frequency points in each sub-band, and after that, inverse conversion is executed.

The shaper 205 receives the time domain signal from the inverse converter 204, executes shaping processing, and outputs the shaping result as the enhanced signal. Shaping processing includes smoothing and prediction of a signal. When smoothing is performed, the shaping result changes more smoothly with time as compared to the plurality of signal samples received from the converter 201. When linear prediction is performed, the shaper 205 obtains the shaping result as the linear combination of the plurality of signal samples received from the inverse converter 204. A coefficient representing the linear combination can be obtained by the Levinson-Durbin algorithm using the plurality of signal samples received from the inverse converter 204. The latest sample may be predicted using the latest sample (the sample that is temporally the latest) in the plurality of signal samples from the inverse converter 204 and a past sample. The coefficient representing the linear combination can also be obtained using a gradient method or the like such that the expectation value of the square error of the difference between the prediction results (the linear combination of past samples using prediction coefficients) is minimized. Since a missing harmonic component is compensated, the linear combination result changes more smoothly with time as compared to the plurality of signal samples received from the inverse converter 204. The shaper 205 may perform nonlinear prediction based on a nonlinear filter such as a Volterra filter.

Figure 3:
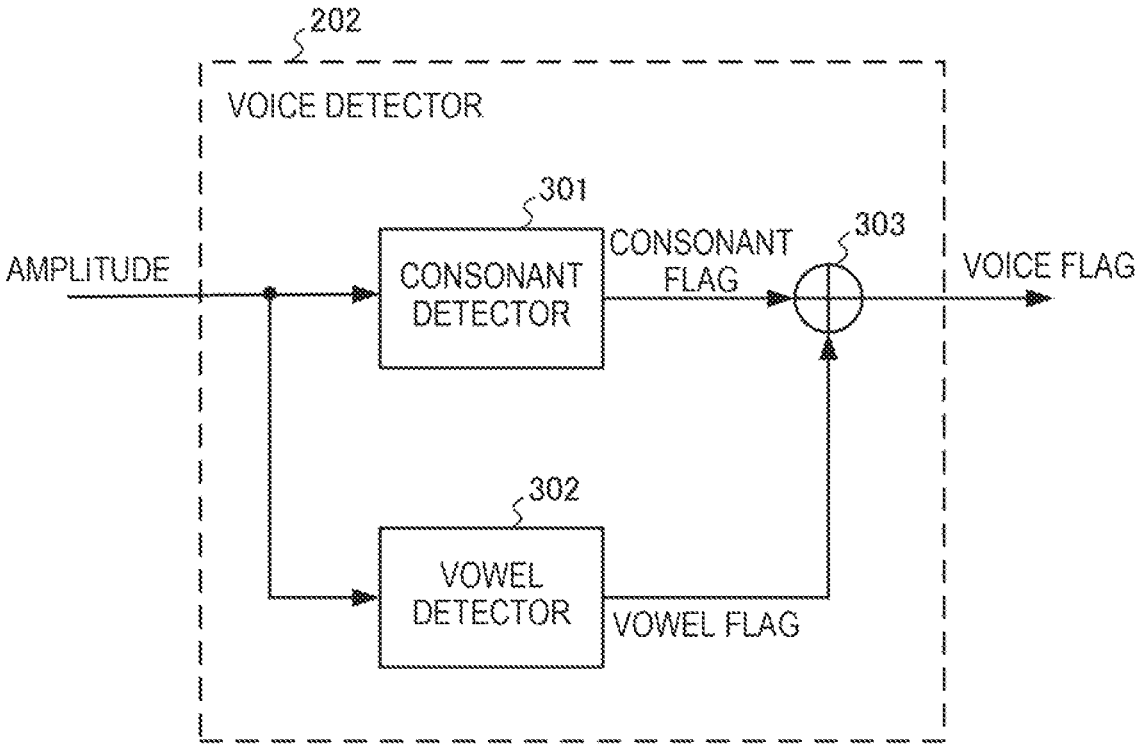
FIG. 3 is a view showing the arrangement of a voice detector according to the second example embodiment of the present invention.

FIG. 3 is a block diagram showing an example of the arrangement of the voice detector 202. As shown in FIG. 3, the voice detector 202 includes a consonant detector 301, a vowel detector 302, and an OR calculator 303.

The consonant detector 301 receives the amplitudes at the plurality of frequencies, detects a consonant on a frequency basis, and outputs, as a consonant flag, 1 when a consonant is detected, and 0 when a consonant is not detected. The vowel detector 302 receives the amplitudes at the plurality of frequencies, detects a vowel on a frequency basis, and outputs, as a vowel flag, 1 when a vowel is detected, and 0 when a vowel is not detected. The OR calculator 303 receives the consonant flag from the consonant detector 301 and the vowel flag from the vowel detector 302, obtains the OR of the flags, and outputs a voice flag. That is, the voice flag is 1 when one of the consonant flag and the vowel flag is 1, or 0 when both the consonant flag and the vowel flag are 0. When one of a consonant and a vowel exists, it is determined that a voice exists.

Figure 4:
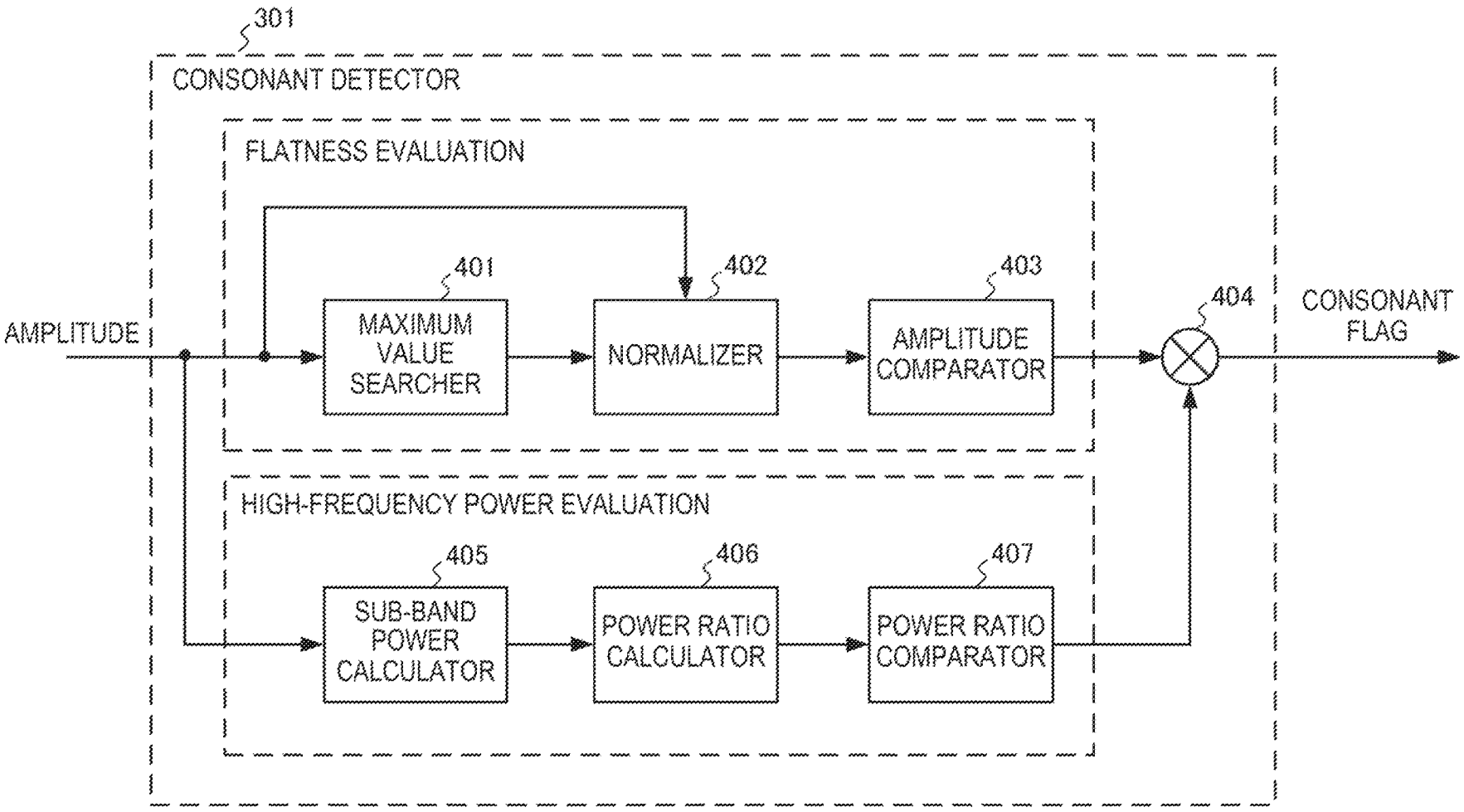
FIG. 4 is a view showing the arrangement of a consonant detector according to the second example embodiment of the present invention.

FIG. 4 is a block diagram showing an example of the arrangement of the consonant detector 301. As shown in FIG. 4, the consonant detector 301 has an arrangement including a maximum value searcher 401, a normalizer 402, an amplitude comparator 403, a sub-band power calculator 405, a power ratio calculator 406, a power ratio comparator 407, and an AND calculator 404.

The maximum value searcher 401, the normalizer 402, and the amplitude comparator 403 form a flatness evaluator that detects that the flatness of an amplitude spectrum is high throughout all bands. The sub-band power calculator 405, the power ratio calculator 406, and the power ratio comparator 407 form a high-frequency power evaluator that detects that a power in a high-frequency range is large. The AND calculator 404 outputs, as a consonant flag, 1 when two conditions that the amplitude spectrum flatness is high, and the high-frequency power is large are satisfied, or 0 when the conditions are not satisfied. The consonant detector may be formed from only one of the flatness evaluator and the high-frequency power evaluator.

The maximum value searcher 401 receives the amplitudes at the plurality of frequencies and obtains the maximum value. The normalizer 402 obtains the sum of the amplitudes at the plurality of frequencies, and normalizes it by the maximum value obtained by the maximum value searcher 401, thereby obtaining a normalized total amplitude. The amplitude comparator 403 receives the normalized total amplitude from the normalizer 402, compares it with a predetermined threshold, and outputs 1 if the normalized total amplitude is larger than the threshold or 0 otherwise. If the flatness of the amplitude spectrum is high, the maximum value of the amplitude almost equals the other amplitudes is not remarkably large. Hence, the normalized total amplitude relatively has a large value. For this reason, if the normalized total amplitude exceeds the threshold, it is judged that the flatness of the amplitude spectrum is high, and the output of the amplitude comparator 403 is set to 1. Conversely, if the flatness of the amplitude spectrum is low, the variance of amplitude values is large, and the possibility that the maximum value is much larger than the other amplitudes is high. Hence, the normalized total amplitude relatively has a small value. In this case, the normalized total amplitude does not have a value larger than the threshold, and the output of the amplitude comparator 403 is set to 0. By the above-described operation, the maximum value searcher 401, the normalizer 402, and the amplitude comparator 403 can detect that the flatness of the amplitude spectrum is high throughout all bands.

The sub-band power calculator 405 receives the amplitudes at the plurality of frequencies, and calculates the intra-sub-band total power for each of a plurality of sub-bands that form the subsets of all frequency points. The sub-bands may equally divide or unequally divide all the bands.

The power ratio calculator 406 receives the plurality of sub-band powers from the sub-band power calculator 405, and calculates a power ratio by dividing the power of a high-frequency sub-band by the power of a low-frequency sub-band. If the number of sub-bands is two, the power ratio calculation method is uniquely determined. If the number of sub-bands exceeds two, the high-frequency sub-band and the low-frequency sub-band are arbitrarily selected. Arbitrary sub-bands are selected, and the total power of sub-bands in which the frequency is always high is divided by the total power of sub-bands in which the frequency is low, thereby calculating the power ratio.

The power ratio comparator 407 receives the power ratio from the power ratio calculator 406, compares it with a predetermined threshold, and outputs 1 if the power ratio is larger than the threshold or 0 otherwise. If a high-frequency power is larger than a low-frequency power, a voice is a consonant at a high probability. Conversely, it is known that a low-frequency power is larger than a high-frequency power in a vowel. Hence, the powers of a high frequency and a low frequency are calculated, and the ratio is compared with a threshold, thereby determining whether a voice is a consonant or not. By the above-described operation, the sub-band power calculator 405, the power ratio calculator 406, and the power ratio comparator 407 can detect that the power of a high frequency is large.

Figure 5:
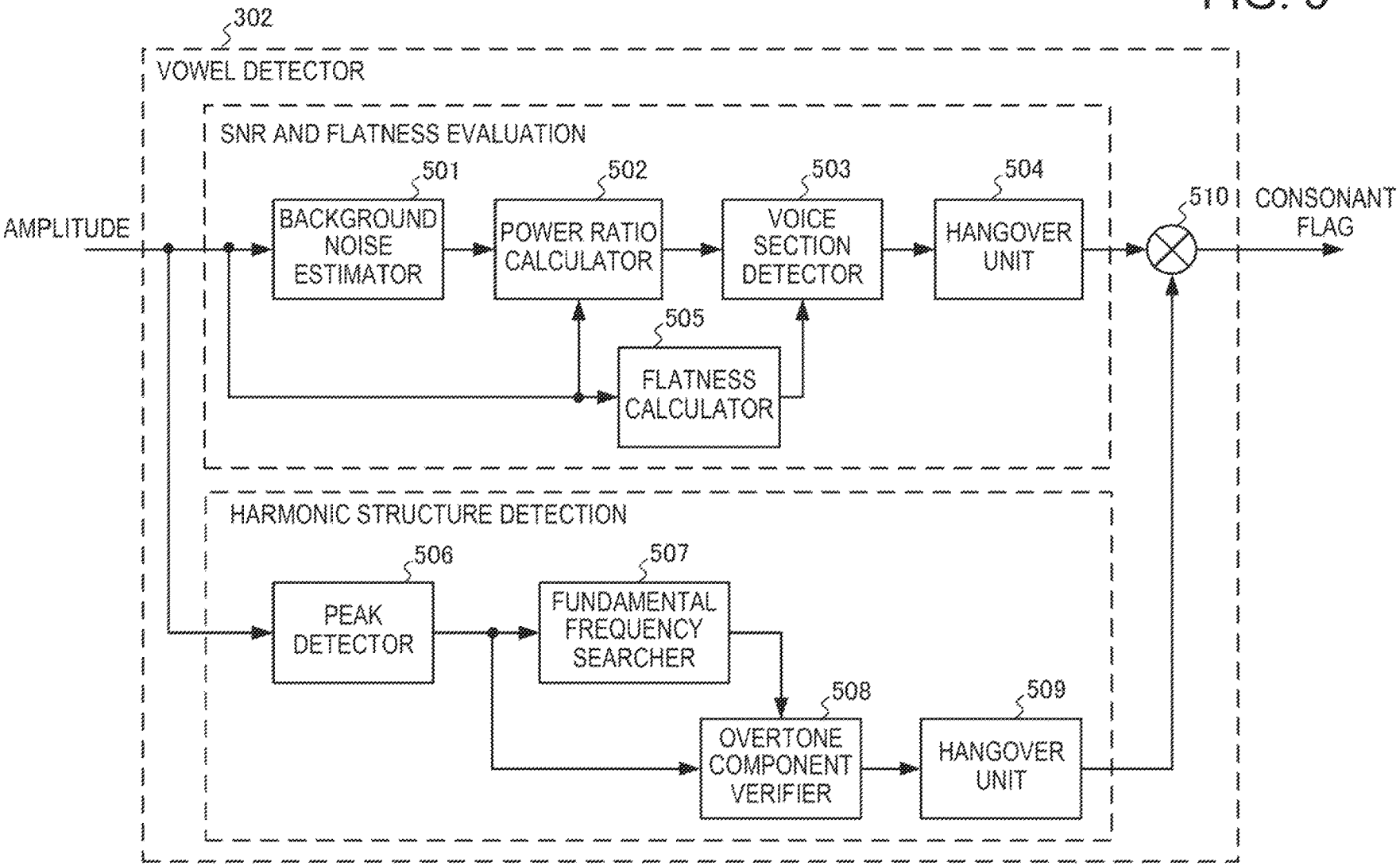
FIG. 5 is a view showing the arrangement of a vowel detector according to the second example embodiment of the present invention.

FIG. 5 is a view showing an example of the arrangement of the vowel detector 302. The vowel detector 302 includes a background noise estimator 501, a power ratio calculator 502, a voice section detector 503, a hangover unit 504, a flatness calculator 505, a peak detector 506, a fundamental frequency searcher 507, an overtone component verifier 508, a hangover unit 509, and an AND calculator 510.

The background noise estimator 501, the power ratio calculator 502, the voice section detector 503, the hangover unit 504, and the flatness calculator 505 form an SNR and flatness evaluator that detects that the SNR (Signal to Noise Ratio) is high, and the amplitude spectrum flatness is high. The peak detector 506, the fundamental frequency searcher 507, the overtone component verifier 508, and the hangover unit 509 form a harmonic structure detector that detects the existence of a harmonic structure. The AND calculator 510 outputs, as a vowel flag, 1 when three conditions that the SNR is high, the amplitude spectrum flatness is high, and a harmonic structure exists are satisfied, or 0 when the conditions are not satisfied. The vowel detector 302 may be formed by one of the SNR and flatness evaluator and the harmonic structure detector.

The background noise estimator 501 receives the amplitudes at the plurality of frequencies, and estimates background noise on a frequency basis. Background noise may include all signal components other than the target signal. As the noise estimation method, a minimum statistics method, weighted noise estimation, and the like are disclosed in non-patent literature 1 and non-patent literature 2. However, a method other than these can also be used. The power ratio calculator 502 receives the amplitudes at the plurality of frequencies and background noise estimation values at the plurality of frequencies, which are calculated by the background noise estimator 501, and calculates a plurality of power ratios at each frequency. When the estimated noise is set to the denominator, the power ratio approximately represents the SNR.

The flatness calculator 505 calculates the amplitude flatness in the frequency direction using the amplitudes at the plurality of frequencies. As an example of flatness, a spectrum flatness (SFM: Spectral Flatness Measure) or the like can be used.

The voice section detector 503 receives the SNR and the amplitude flatness, if the SNR is higher than a predetermined threshold, and the flatness is lower than a predetermined threshold, declares that it is a voice section and outputs 1, or outputs 0 otherwise. These values are calculated for each frequency point. The threshold may equally be set at all frequency points or may be set to different values. In a vowel section of a voice, generally, the SNR is high, and the amplitude flatness is low. Hence, the voice section detector 503 can detect a vowel.

The hangover unit 504 holds a detection result in the past during a predetermined number of samples if the output of the voice section detector does not change during the number of samples larger than a predetermined threshold. For example, when a continuous sample count threshold is 4, and the number of held samples is 2, if a non-voice section is determined for the first time after four or more voice sections continued in the past, a value "1" representing a voice section is forcibly output during two samples after that. This can prevent an adverse effect that occurs because the power is generally weak at the termination of a voice section, and the portion is readily erroneously determined as a non-voice section.

The peak detector 506 searches the amplitudes at the plurality of frequencies in the frequency direction from the low-frequency region to the high-frequency region, and identifies a frequency having an amplitude value larger than values at adjacent frequencies on both the high- and low-frequency sides. Comparison with one sample on each of the high- and low-frequency sides may be performed, or a plurality of conditions to compare with a plurality of samples may be imposed. The number of samples to be compared may be changed between the low-frequency side and the high-frequency side. When a human audible sense characteristic is reflected, in general, comparison with a larger number of samples is performed on the high-frequency side than on the low-frequency side.

The fundamental frequency searcher 507 obtains the lowest value in the detected peak frequencies, and sets it to the fundamental frequency. If the amplitude value at the fundamental frequency is not larger than a predetermined value, or if the fundamental frequency does not fall within a predetermined frequency range, the second lowest peak frequency is set to the fundamental frequency.

The overtone component verifier 508 verifies whether an amplitude at a frequency corresponding to an integer multiple of the fundamental frequency is much larger than the amplitude at the fundamental frequency. In general, the amplitude at the fundamental frequency or the amplitude in the second overtone is maximum, and the amplitude becomes smaller as the frequency becomes higher. Hence, an overtone is verified in consideration of this characteristic. Normally, the third to fifth overtones are verified. If the existence of an overtone can be confirmed, 1 is output. Otherwise, 0 is output. The existence of an overtone proves the existence of an obvious harmonic structure.

The hangover unit 509 holds a detection result in the past during a predetermined number of samples if the output of the overtone verifier does not change during the number of samples larger than a predetermined threshold. For example, when a continuous sample count threshold is 4, and the number of held samples is 2, if a non-overtone section is determined for the first time after four or more overtone sections continued in the past, a value "1" representing an overtone section is forcibly output during two samples after that. This can prevent an adverse effect that occurs because the power is generally weak at the termination of a voice section, an overtone is hard to detect, and the portion is readily erroneously determined as a non-overtone section.

The hangover units 504 and 509 perform processing for raising the detection accuracy of a voice section and an overtone section at the termination of a voice section. Hence, even if the hangover units 504 and 509 do not exist, the same vowel detection result can be obtained, although the accuracy changes.

By the above-described operation, the vowel detector 302 can detect a vowel.

Figure 6:
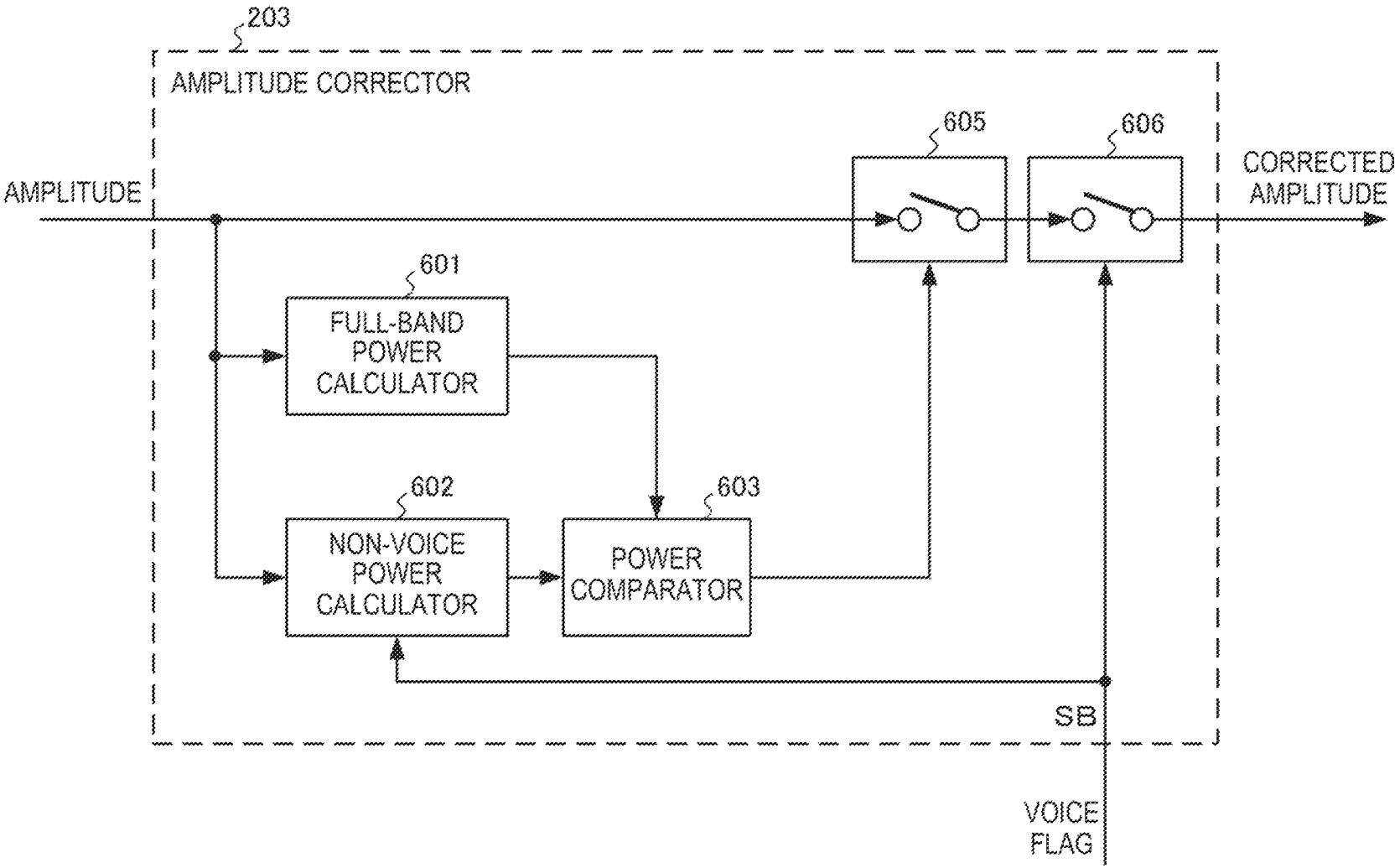
FIG. 6 is a view showing the arrangement of an amplitude corrector according to the second example embodiment of the present invention.

FIG. 6 is a block diagram showing an example of the arrangement of the amplitude corrector 203. As shown in FIG. 6, the amplitude corrector 203 includes a full-band power calculator 601, a non-voice power calculator 602, a power comparator 603, a switch 605, and a switch 606. The amplitude corrector 203 receives an input signal amplitude, an impact sound flag, and a voice flag, and outputs the input signal amplitude only when the input signal is not an impact sound but a voice.

The full-band power calculator 601 receives the amplitudes at the plurality of frequencies, and obtains the power sum in all bands. The full-band power calculator 601 also divides the power sum by the number of frequency points in all bands, and obtains the quotient as an average full-band power.

The non-voice power calculator 602 receives the amplitudes at the plurality of frequencies and voice flags at the plurality of frequencies, and obtains the power sum of frequency points determined as non-voice. The non-voice power calculator 602 also divides the power sum by the number of frequency points determined as non-voice, and obtains the quotient as an average power of non-voice.

The power comparator 603 receives the average full-band power and the average non-voice power, and obtains the ratio between them. If the value of the ratio is close to 1, the values of the average full-band power and the average non-voice power are close, and the input signal is a non-voice. The power comparator 603 outputs 1 if it is determined that the input signal is a non-voice, or 0 otherwise. That is, 0 represents a voice.

The switch 605 receives the output of the power comparator 603, and when the output of the power comparator 603 is 0, that is, represents a voice, closes the circuit, and outputs the amplitude of the input signal.

The switch 606 receives the output of the switch 605 and the voice flag, and when the voice flag is 0, that is, a voice exists, closes the circuit, and outputs the output of the switch 605 as a corrected amplitude.

By the above-described operation, the amplitude corrector 203 can output the input signal amplitude as a corrected amplitude only when the input signal is a voice.

With the above-described arrangement, after a voice included in an input signal is detected, and the input signal is corrected in correspondence with the existence of the voice, the signal is further shaped and output as an enhanced signal. Hence, even if the phase of the input signal is largely different from the phase of the true voice, an output signal of sufficiently high quality can be obtained.

Third Example Embodiment

Figure 7:
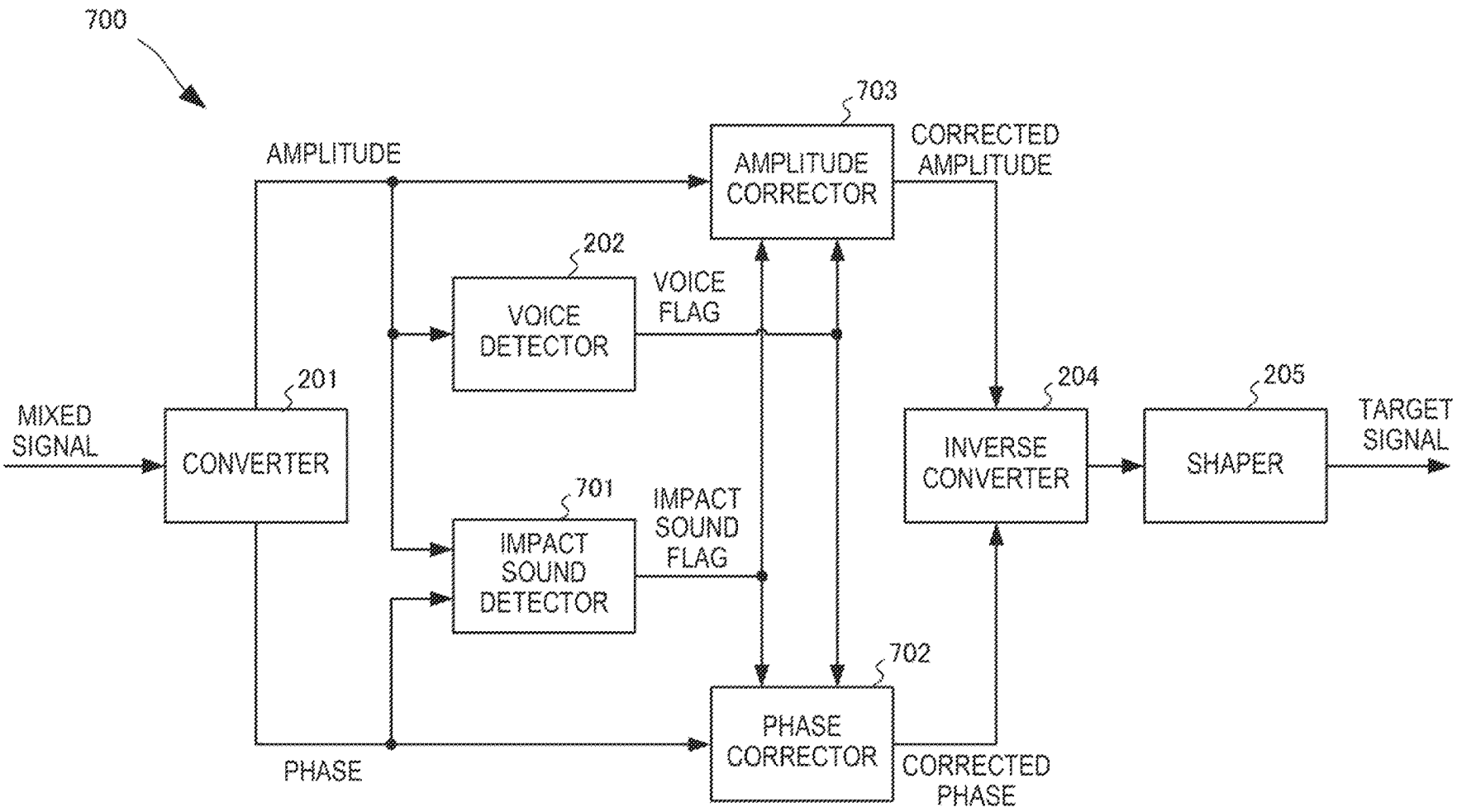
FIG. 7 is a block diagram showing the arrangement of a signal processing apparatus according to the third example embodiment of the present invention.

A signal processing apparatus according to the third example embodiment of the present invention will be described with reference to FIG. 7. A signal processing apparatus 700 according to this example embodiment is different from the signal processing apparatus 200 shown in FIG. 2 in that an impact sound detector 701 and a phase corrector 702 are added. The rest of the components and operations is the same as in the signal processing apparatus 200. Hence, the same reference numerals denote the same components and operations, and a detailed description thereof will be omitted.

Figure 8:
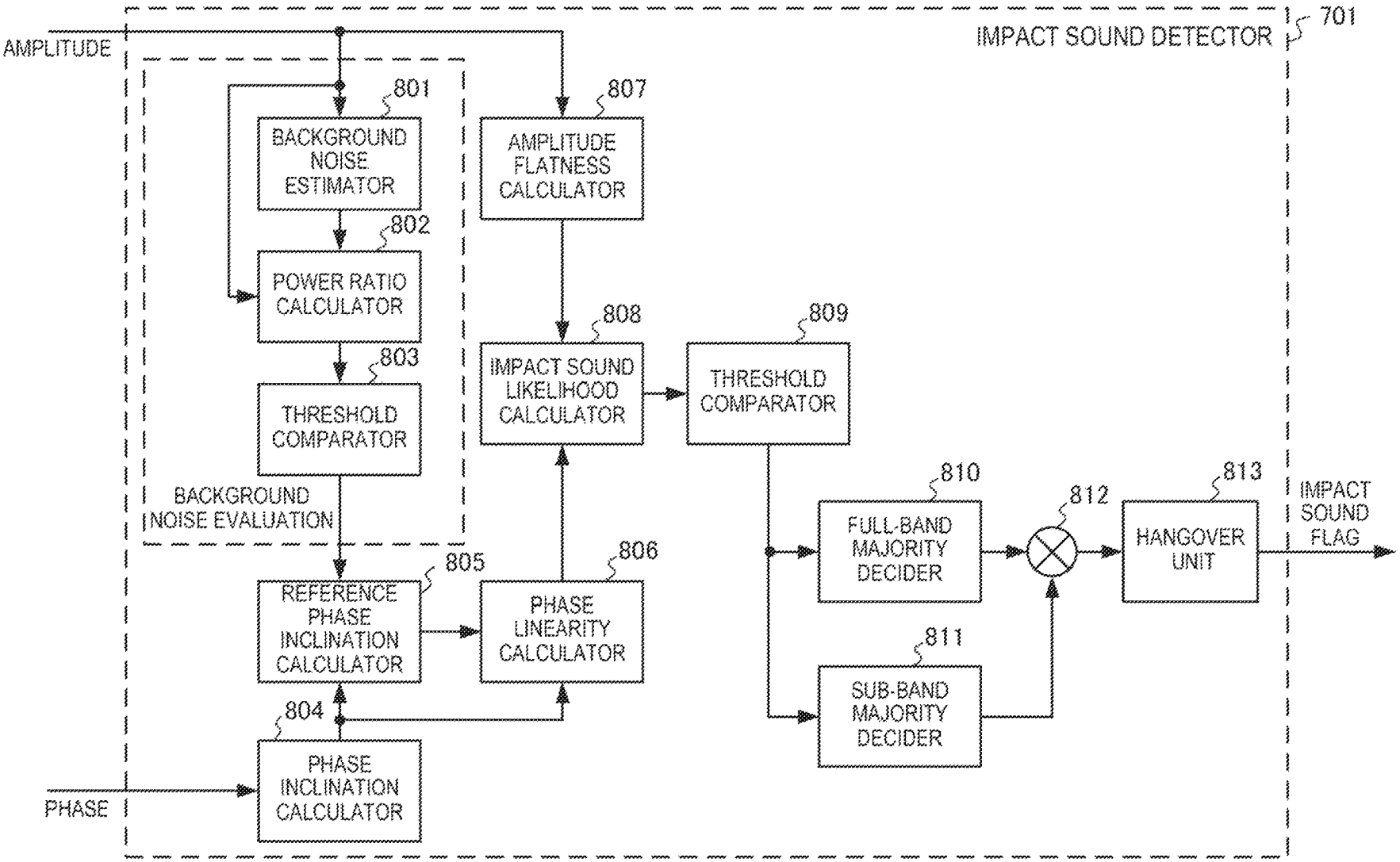
FIG. 8 is a view showing the arrangement of an impact sound detector according to the third example embodiment of the present invention.

FIG. 8 is a block diagram showing an example of the arrangement of the impact sound detector 701. As shown in FIG. 8, the impact sound detector 701 includes a background noise estimator 801, a power ratio calculator 802, a threshold comparator 803, a phase inclination calculator 804, a reference phase inclination calculator 805, a phase linearity calculator 806, an amplitude flatness calculator 807, an impact sound likelihood calculator 808, a threshold comparator 809, a full-band majority decider 810, a sub-band majority decider 811, an AND calculator 812, and a hangover unit 813.

The background noise estimator 801, the power ratio calculator 802, and the threshold comparator 803 form a background noise evaluator that evaluates whether background noise is sufficiently small as compared to an input signal, and outputs 1 when the background noise is sufficiently small, or 0 otherwise.

The background noise estimator 801 receives the amplitudes at the plurality of frequencies, and estimates background noise on a frequency basis. The operation is basically the same as that of the background noise estimator 501. Hence, when the output of the background noise estimator 501 is used as the output of the background noise estimator 801, the background noise estimator 801 can be omitted.

The power ratio calculator 802 receives the amplitudes at the plurality of frequencies and background noise estimation values at the plurality of frequencies, which are calculated by the background noise estimator 801, and calculates a plurality of power ratios at the frequencies. When the estimated noise is set to the denominator, the power ratio approximately represents the SNR. The operation of the power ratio calculator 802 is the same as that of the power ratio calculator 502. When the output of the power ratio calculator 502 is used as the output of the power ratio calculator 802, the power ratio calculator 802 can be omitted.

The threshold comparator 803 compares each power ratio received from the power ratio calculator 802 with a predetermined threshold, and evaluates whether the background noise is sufficiently small. If the power ratio represents the SNR, the threshold comparator 803 outputs 1 as a background noise evaluation result when the power ratio is sufficiently large, or 0 otherwise. If the reciprocal of the SNR is used as the power ratio, the threshold comparator 803 outputs 1 as a background noise evaluation result when the power ratio is sufficiently small, or 0 otherwise.

The phase inclination calculator 804 receives the phases at the plurality of frequencies, and calculates a phase inclination at each frequency point using the relationship between the phase at a frequency and the phase at an adjacent frequency.

The reference phase inclination calculator 805 receives the background noise evaluation results and the phase inclinations, selects the value of the phase inclination at each frequency point at which the background noise is sufficiently small, and calculates a reference phase inclination based on a plurality of selected phases. For example, the average value of the selected phases may be calculated as the reference phase inclination, or another value such as a median or a mode obtained by statistical processing may be used as the reference phase inclination. That is, the reference phase inclination has the same value for all frequencies.

The phase linearity calculator 806 receives the phase inclinations at the plurality of frequencies and the reference phase inclination, compares them, and obtains a phase linearity as the difference or ratio between them at each frequency point.

The amplitude flatness calculator 807 receives the amplitudes at the plurality of frequencies, and calculates the amplitude flatness in the frequency direction. As an example of flatness, a spectrum flatness (SFM: Spectral Flatness Measure) or the like can be used.

The impact sound likelihood calculator 808 receives the phase linearities and the amplitude flatnesses at the plurality of frequencies, and outputs an impact sound existence probability as an impact sound likelihood. The higher the phase linearity is, the higher the impact sound likelihood is set. In addition, the higher the amplitude flatness is, the higher the impact sound likelihood is set. This is because an impact sound has the characteristics of high phase linearity and high amplitude flatness. The phase linearity and the amplitude flatness can be combined in any way. Only one of them may be used, or a weighted sum of them may be used.

The threshold comparator 809 receives each impact sound likelihood, compares it with a predetermined threshold, and evaluates the existence of an impact sound at each frequency. The threshold comparator 809 outputs 1 when the impact sound likelihood is larger than the predetermined threshold, or 0 otherwise.

The full-band majority decider 810 receives the impact sound existence situations at the plurality of frequencies, and evaluates the existence of an impact sound in the full band (all frequency bands). For example, majority decision concerning 1 representing the existence of an impact sound is made at all frequency points. If the result is majority, it is determined that an impact sound exists at all frequencies, and the values at all frequency points are replaced with 1.

The sub-band majority decider 811 receives the impact sound existence situations at the plurality of frequencies, and evaluates the existence of an impact sound in each sub-band (partial frequency band). For example, majority decision concerning 1 representing the existence of an impact sound is made in each sub-band. If the result is majority, it is determined that an impact sound exists in the sub-band, and the values at all frequency points in the sub-band are replaced with 1.

The AND calculator 812 calculates the AND of impact sound existence information obtained as the result of full-band majority decision and impact sound existence information obtained as the result of sub-band majority decision, and represents final impact sound existence information for each frequency point by 1 or 0.

The hangover unit 813 holds existence information in the past during a predetermined number of samples if the impact sound existence information does not change during the number of samples larger than a predetermined threshold. For example, when a continuous sample count threshold is 4, and the number of held samples is 2, if it is determined that an impact sound is absent for the first time after impact sound existence continued four or more times in the past, a value "1" representing the existence of an impact sound is forcibly output during two samples after that. This can prevent an adverse effect that occurs because the impact sound power is generally weak at the termination of a voice impact sound section, an impact sound is hard to detect, and it is readily erroneously determined that an impact sound is absent.

The hangover unit 813 performs processing for raising the detection accuracy of an impact sound at the termination of an impact sound section. Hence, even if the hangover unit 813 does not exist, the same impact sound detection result can be obtained, although the accuracy changes.

By the above-described operation, the background noise estimator 801, the power ratio calculator 802, the threshold comparator 803, the phase inclination calculator 804, the reference phase inclination calculator 805, the phase linearity calculator 806, the amplitude flatness calculator 807, the impact sound likelihood calculator 808, the threshold comparator 809, the full-band majority decider 810, the sub-band majority decider 811, the AND calculator 812, and the hangover unit 813 can detect an impact sound.

Figure 9:
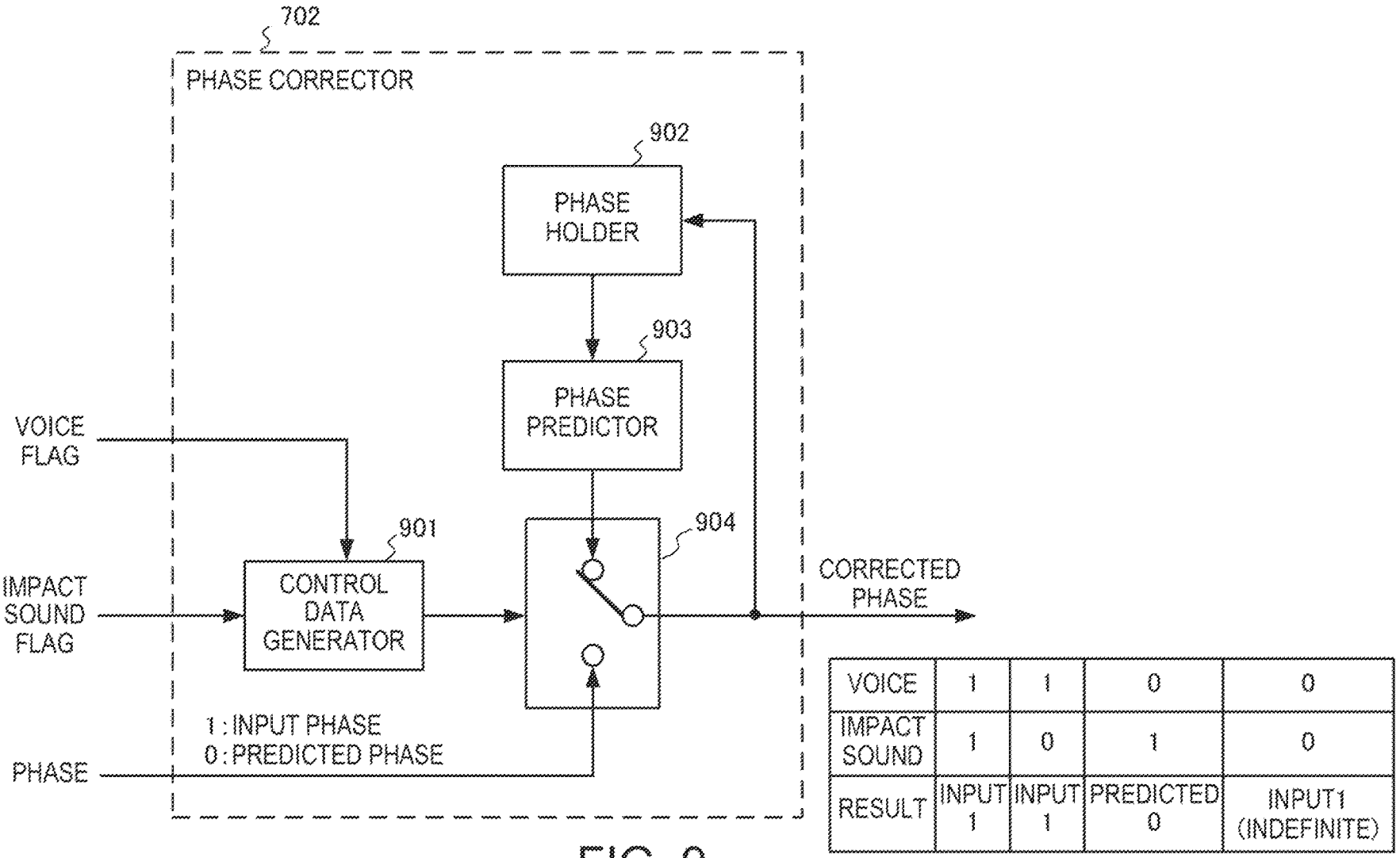
FIG. 9 is a view showing the arrangement of a phase corrector according to the third example embodiment of the present invention.

FIG. 9 is a block diagram showing an example of the arrangement of the phase corrector 702. As shown in FIG. 9, the phase corrector 702 has an arrangement including a control data generator 901, a phase holder 902, a phase predictor 903, and a switch 904. The phase corrector 702 receives the voice flag, the impact sound flag, and the phase of the input signal, and outputs, as a corrected phase, the phase of the input signal when the input signal is a voice, a predicted phase when the input signal is not a voice but an impact sound, and the phase of the input signal when the input signal is neither a voice nor an impact sound.

The control data generator 901 outputs control data in accordance with the states of the voice flag and the impact sound flag. The control data generator 901 outputs 1 when the voice flag is 1, 0 when the voice flag is 0, and the impact sound flag is 1, and 1 when both the voice flag and the impact sound flag are 0. If both the voice flag and the impact sound flag are 0, the power of the input signal is not large. Hence, since the influence on the output signal can be neglected, the control data generator 901 may output 0 when both the voice flag and the impact sound flag are 0. In this case, independently of the value of the impact sound flag, the output of the control data generator 901 is 1 when the voice flag is 1 or 0 when the voice flag is 0. That is, the control data generator 901 may be configured to receive only the voice flag and output, as control data, 1 when the voice flag is 1 or 0 when the voice flag is 0.

The phase holder 902 receives the corrected phase that is the output of the phase corrector 702, and holds it. The phase predictor 903 receives the phase held by the phase holder 902, and predicts the current phase using it. Letting f be the frequency, Fs be the sampling frequency, and M be the number of samples of a frame shift, the time shift between adjacent frames is M/Fs sec. The phase advances by $2\pi f$ in a second. Hence, letting $\theta k$ be the phase in a frame k, and $\theta k-1$ be the phase in a frame k−1, $$\theta k=\theta k-1+2\pi fM/Fs$$

holds. That is, the phase held by the phase holder 902 is $\theta k-1$, and the predicted phase output from the phase predictor 903 is $\theta k$.

The switch 904 selects the phase of the input signal when the control data supplied from the control data generator 901 is 1, or the predicted phase when the control data supplied from the control data generator 901 is 0, and outputs the selected phase as a corrected phase.

By the above-described operation, the control data generator 901, the phase holder 902, the phase predictor 903, and the switch 904 output, as a corrected phase, the phase of the input signal when the input signal is a voice, the predicted phase when the input signal is not a voice but an impact sound, and the phase of the input signal when the input signal is neither a voice nor an impact sound.

Figure 10:
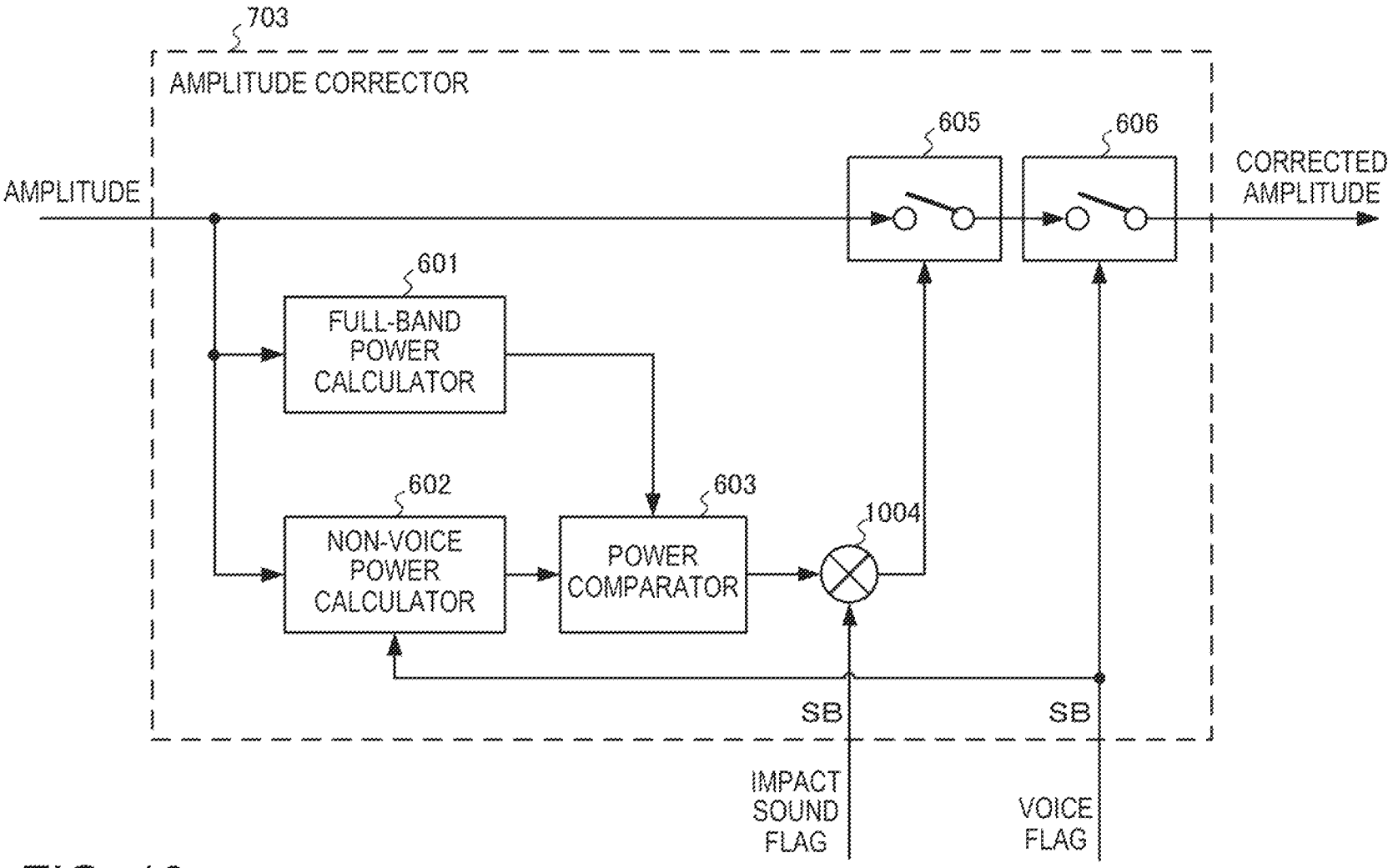
FIG. 10 is a view showing the arrangement of an amplitude corrector according to the third example embodiment of the present invention.

FIG. 10 is a block diagram showing an example of the arrangement of the amplitude corrector 703. As shown in FIG. 10, the amplitude corrector 703 is different from the amplitude corrector 203 shown in FIG. 6 in that an AND calculator 1004 is added. The rest of the components and operations is the same as in the amplitude corrector 203. Hence, the same reference numerals denote the same components and operations, and a detailed description thereof will be omitted.

The AND calculator 1004 receives the output of a power comparator 603 and the impact sound flag, and outputs the AND of these. That is, the output of the AND calculator 1004 is 1 if the input signal is a voice, or 0 otherwise.

A switch 605 receives the output of the AND calculator 1004, and when the output of the AND calculator 1004 is 0, that is, represents a voice, closes the circuit, and outputs the amplitude of the input signal. The switch 605 further receives the impact sound flag, and if the impact sound flag is 1, that is, an impact sound exists, and the input is a voice, may reduce the amplitude at a frequency between the peak frequencies of the voice. This corresponds to reducing the amplitude spectrum between the peak frequencies, and provides an effect of making the amplitude spectrum that is flattened by the impact sound component close to the amplitude spectrum of the voice.

By the above-described operation, the amplitude corrector 703 can output the input signal amplitude as a corrected amplitude only when the input signal is not an impact sound but a voice.

With the above-described arrangement, the signal processing apparatus 700 detects a voice included in an input signal, and corrects the input signal in correspondence with the existence of the voice. After that, the signal processing apparatus 700 further shapes the signal and outputs it as an enhanced signal. Hence, even if the input signal includes an impact sound component, and the phase of the input signal is largely different from the phase of the true voice, an output signal of sufficiently high quality can be obtained.

Fourth Example Embodiment

Figure 11:
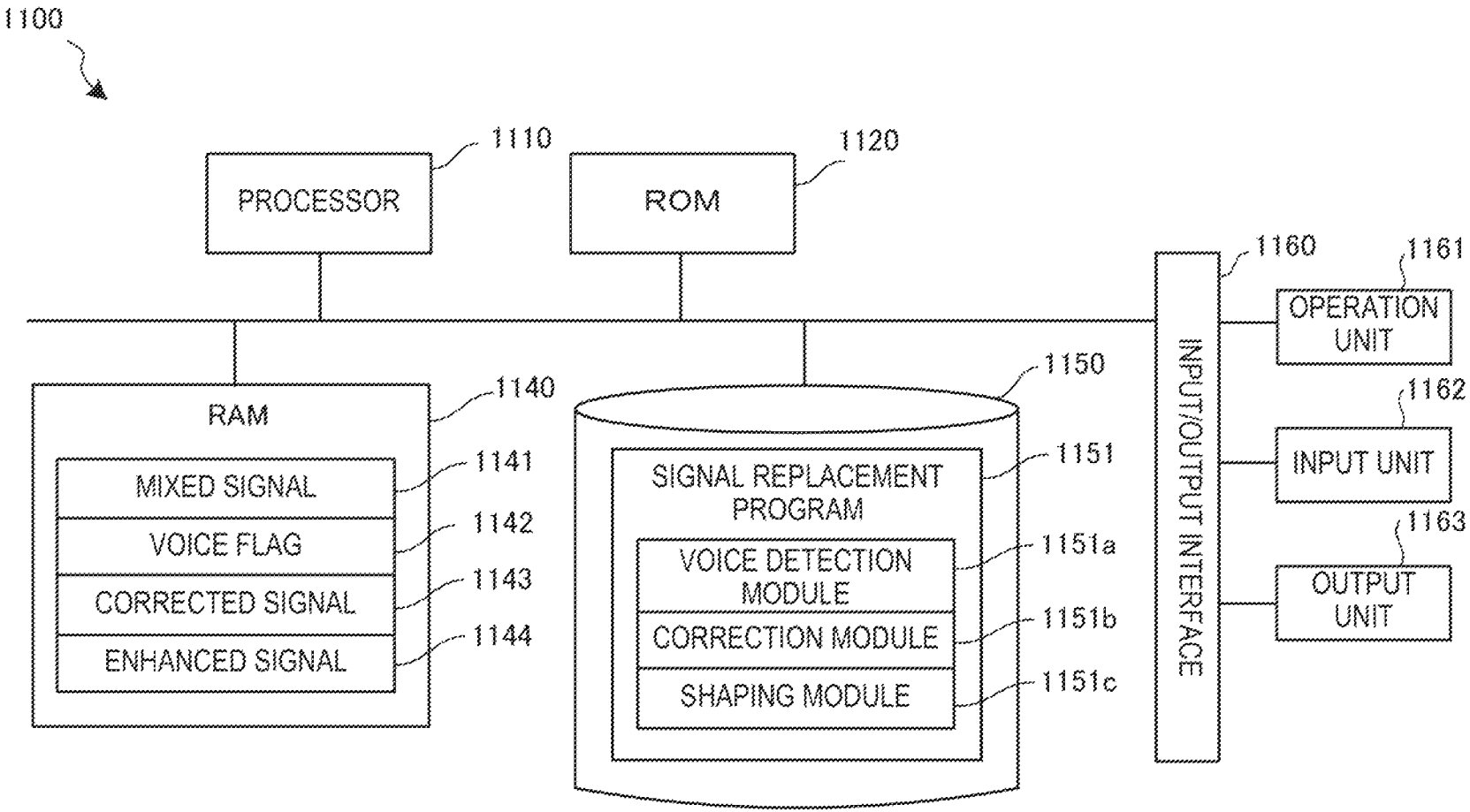
FIG. 11 is a block diagram showing the arrangement of a signal processing apparatus according to the fourth example embodiment of the present invention.

A signal processing apparatus according to the fourth example embodiment of the present invention will be described with reference to FIGS. 11 and 12. FIG. 11 is a block diagram for explaining a hardware arrangement in a case in which a signal processing apparatus 1100 according to this example embodiment is implemented using software.

The signal processing apparatus 1100 includes a processor 1110, a ROM (Read Only Memory) 1120, a RAM (Random Access Memory) 1140, a storage 1150, an input/output interface 1160, an operation unit 1161, an input unit 1162, and an output unit 1163. The processor 1110 is a central processing unit, and controls the entire signal processing apparatus 1100 by executing various programs.

The ROM 1120 stores various kinds of parameters and the like in addition to a boot program that the processor 1110 should execute first. In addition to a program load area (not shown), the RAM 1140 includes areas configured to store a mixed signal 1141 (input signal), a voice flag 1142, a corrected signal 1143, an enhanced signal 1144, and the like.

The storage 1150 stores a signal processing program 1151. The signal processing program 1151 includes a voice detection module 1151*a*, a correction module 1151*b*, and a shaping module 1151*c*. The processor 1110 executes the modules included in the signal processing program 1151, thereby implementing the functions of the voice detector 101, the corrector 102, and the shaper 103 shown in FIG. 1.

The enhanced signal 1144 that is an output concerning the signal processing program 1151 executed by the processor 1110 is output from the output unit 1163 via the input/output interface 1160. This makes it possible to enhance, for example, a target signal included in the mixed signal 1141 input from the input unit 1162.

Figure 12:
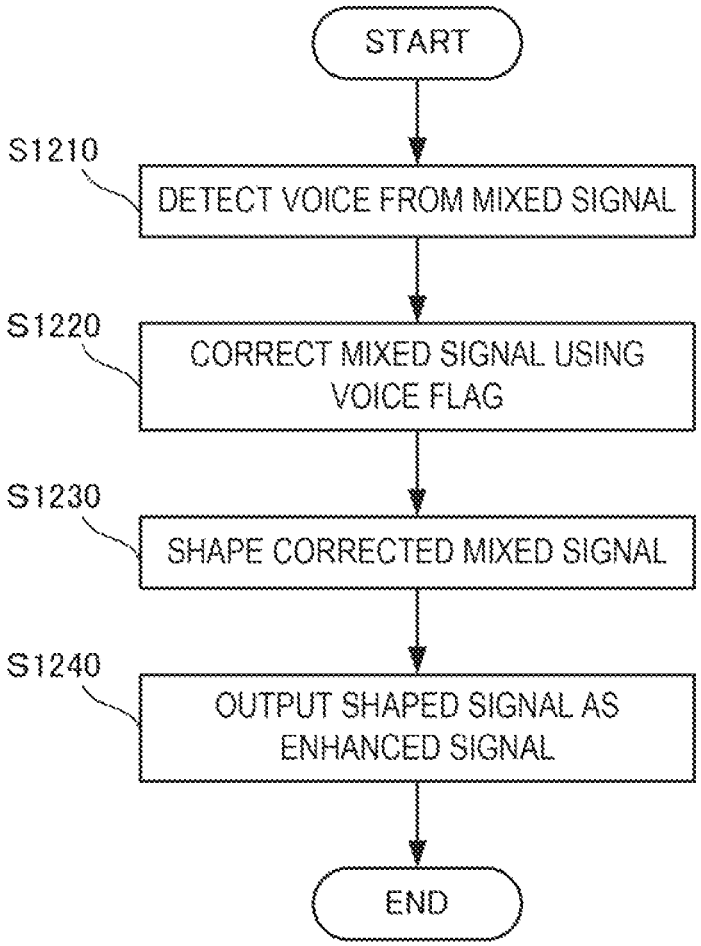
FIG. 12 is a flowchart for explaining the procedure of processing of the signal processing apparatus according to the fourth example embodiment of the present invention.

FIG. 12 is a flowchart for explaining the procedure of processing of enhancing a target signal by the signal processing program 1151 in the signal processing apparatus 1100 according to this example embodiment. In step S1210, the mixed signal 1141 including a target signal and a background signal is supplied to the voice detection module 1151*a*. In step S1220, a voice is detected from the mixed signal, and the result is obtained as a voice flag.

Next, in step S1230, the mixed signal is corrected using the voice flag 1142. Next, in step S1240, the corrected mixed signal is shaped.

Finally, in step S1250, the shaped signal is output as an enhanced signal. In these processes, the processing order of steps S1220 and S1230 and that of steps S1230 and S1240 can be reversed.

An example of the procedure of processing of the signal processing apparatus 1100 according to this example embodiment has been described with reference to FIGS. 11 and 12. However, any of the first to third example embodiments can similarly be implemented by software by appropriately omitting and adding the differences in the block diagrams.

With this arrangement, the signal processing apparatus 1100 detects a voice included in an input signal, and corrects the input signal in correspondence with the existence of the voice. After that, the signal processing apparatus 1100 further shapes the signal and outputs it as an enhanced signal. Hence, even if the phase of the input signal is largely different from the phase of the true voice, an output signal of sufficiently high quality can be obtained.

Other Example Embodiments

While the invention has been particularly shown and described with reference to example embodiments thereof, the invention is not limited to these example embodiments. It will be understood by those of ordinary skill in the art that various changes in form and details may be made therein without departing from the spirit and scope of the present invention as defined by the claims. A system or apparatus including any combination of the individual features included in the respective example embodiments may be incorporated in the scope of the present invention.

The present invention is applicable to a system including a plurality of devices or a single apparatus. The present invention is also applicable even when an information processing program for implementing the functions of example embodiments is supplied to the system or apparatus directly or from a remote site. Hence, the present invention also incorporates the program installed in a computer to implement the functions of the present invention by the computer, a medium storing the program, and a WWW (World Wide Web) server that causes a user to download the program. Especially, the present invention incorporates at least a non-transitory computer readable medium storing a program that causes a computer to execute processing steps included in the above-described example embodiments.

Other Expressions of Example Embodiments

Some or all of the above-described embodiments can also be described as in the following supplementary notes but are not limited to the followings.

(Supplementary Note 1)

There is provided a signal processing apparatus comprising:

a voice detector that receives a mixed signal including a voice and a signal other than the voice and obtains existence of the voice as a voice flag;

a corrector that receives the mixed signal and the voice flag and obtains a corrected mixed signal generated by correcting the mixed signal in accordance with a state of the voice flag; and a shaper that receives the corrected mixed signal and shapes the corrected mixed signal.

(Supplementary Note 2)

There is provided a signal processing apparatus comprising:

a converter that receives a mixed signal including a voice and a signal other than the voice and obtains amplitudes and phases corresponding to a plurality of frequency components;

a voice detector that obtains existence of a voice included in the amplitude as a voice flag;

an amplitude corrector that receives the mixed signal and the voice flag and obtains a corrected amplitude generated by correcting the amplitude in accordance with a state of the voice flag;

an inverse converter that receives the corrected amplitude and the phase and converts the corrected amplitude and the phase into a time domain signal; and a shaper that shapes the time domain signal.

(Supplementary Note 3)

The signal processing apparatus according to Supplementary Note 2 further comprises:

an impact sound detector that receives the amplitude and the phase and obtains existence of an impact sound included in the amplitude as an impact sound flag; and a phase corrector that receives the voice flag, the impact sound flag, and the phase and obtains a corrected phase generated by correcting the phase in accordance with the states of the voice flag and the impact sound flag, wherein the inverse converter receives the corrected amplitude and the corrected phase and converts the corrected amplitude and the corrected phase into the time domain signal.

(Supplementary Note 4)

In the signal processing apparatus according to Supplementary Note 2 or 3, the voice detector includes:

a consonant detector that receives the amplitude and detects a consonant; and a vowel detector that receives the amplitude and detects a vowel.

(Supplementary Note 5)

In the signal processing apparatus according to Supplementary Note 2 or 3, the amplitude corrector receives the amplitude and the voice flag, obtains the amplitude as the corrected amplitude if a voice exists, and obtains 0 as the corrected amplitude if a voice does not exist.

(Supplementary Note 6)

In the signal processing apparatus according to Supplementary Note 3, the impact sound detector includes:

an amplitude flatness calculator that calculates a flatness of the amplitude; and a phase linearity calculator that calculates linearity of the phase with respect to a frequency.

(Supplementary Note 7)

In the signal processing apparatus according to Supplementary Note 3, the phase corrector obtains a phase of the mixed signal as the corrected phase if a voice exists, and obtains a predicted phase based on a past phase as the corrected phase if a voice does not exist.

(Supplementary Note 8)

There is provided a signal processing method comprising:

receiving a mixed signal including a voice and a signal other than the voice and obtaining amplitudes and phases corresponding to a plurality of frequency components;

obtaining existence of a voice included in the amplitude as a voice flag;

receiving the mixed signal and the voice flag and obtaining a corrected amplitude generated by correcting the amplitude in accordance with a state of the voice flag;

receiving the corrected amplitude and the phase and converting the corrected amplitude and the phase into a time domain signal; and shaping the time domain signal.

(Supplementary Note 9)

There is provided a signal processing program for causing a computer to execute a method, comprising:

receiving a mixed signal including a voice and a signal other than the voice and obtaining amplitudes and phases corresponding to a plurality of frequency components;

obtaining existence of a voice included in the amplitude as a voice flag;

receiving the mixed signal and the voice flag and obtaining a corrected amplitude generated by correcting the amplitude in accordance with a state of the voice flag;

receiving the corrected amplitude and the phase and converting the corrected amplitude and the phase into a time domain signal; and shaping the time domain signal.

What is claimed is:

1. A signal processing apparatus comprising:

a converter that receives a mixed signal including a voice and a signal other than the voice and obtains amplitudes and phases corresponding to a plurality of frequency components;

a voice detector that obtains existence of a voice included in the amplitude as a voice flag;

an amplitude corrector that receives the mixed signal and the voice flag and obtains a corrected amplitude generated by correcting the amplitude in accordance with a state of the voice flag;

an inverse converter that receives the corrected amplitude and the phase and converts the corrected amplitude and the phase into a time domain signal;

a shaper that shapes the time domain signal;

an impact sound detector that receives the amplitude and the phase and obtains existence of an impact sound included in the amplitude as an impact sound flag; and a phase corrector that receives the voice flag, the impact sound flag, and the phase and obtains a corrected phase generated by correcting the phase in accordance with the states of the voice flag and the impact sound flag, wherein the inverse converter receives the corrected amplitude and the corrected phase and converts the corrected amplitude and the corrected phase into the time domain signal.

2. The signal processing apparatus according to claim 1, wherein said voice detector includes:

a consonant detector that receives the amplitude and detects a consonant; and a vowel detector that receives the amplitude and detects a vowel.

3. The signal processing apparatus according to claim 1, wherein said amplitude corrector receives the amplitude and the voice flag, obtains the amplitude as the corrected amplitude if a voice exists, and obtains 0 as the corrected amplitude if a voice does not exist.

4. The signal processing apparatus according to claim 1, wherein said impact sound detector includes:

an amplitude flatness calculator that calculates a flatness of the amplitude; and a phase linearity calculator that calculates linearity of the phase with respect to a frequency.

5. The signal processing apparatus according to claim 1, wherein said phase corrector obtains a phase of the mixed signal as the corrected phase if a voice exists, and obtains a predicted phase based on a past phase as the corrected phase if a voice does not exist.

6. A signal processing method comprising:

receiving a mixed signal including a voice and a signal other than the voice and obtaining amplitudes and phases corresponding to a plurality of frequency components;

obtaining existence of a voice included in the amplitude as a voice flag;

receiving the mixed signal and the voice flag and obtaining a corrected amplitude generated by correcting the amplitude in accordance with a state of the voice flag;

receiving the corrected amplitude and the phase and converting the corrected amplitude and the phase into a time domain signal;

shaping the time domain signal;

receiving the amplitude and the phase and obtaining existence of an impact sound included in the amplitude as an impact sound flag; and receiving the voice flag, the impact sound flag, and the phase and obtaining a corrected phase generated by correcting the phase in accordance with the states of the voice flag and the impact sound flag, wherein the corrected amplitude and the corrected phase are converted into the time domain signal.

7. A non-transitory computer readable medium storing a signal processing program for causing a computer to execute a method, comprising:

receiving a mixed signal including a voice and a signal other than the voice and obtaining amplitudes and phases corresponding to a plurality of frequency components;

obtaining existence of a voice included in the amplitude as a voice flag;

receiving the mixed signal and the voice flag and obtaining a corrected amplitude generated by correcting the amplitude in accordance with a state of the voice flag;

receiving the corrected amplitude and the phase and converting the corrected amplitude and the phase into a time domain signal;

shaping the time domain signal;

receiving the amplitude and the phase and obtaining existence of an impact sound included in the amplitude as an impact sound flag; and receiving the voice flag, the impact sound flag, and the phase and obtaining a corrected phase generated by correcting the phase in accordance with the states of the voice flag and the impact sound flag, wherein the corrected amplitude and the corrected phase are converted into the time domain signal.

* * * * *